US005526853A

United States Patent [19]

McPhee et al.

[11] Patent Number: 5,526,853

[45] Date of Patent: Jun. 18, 1996

[54] PRESSURE-ACTIVATED MEDICATION TRANSFER SYSTEM

[75] Inventors: Charles J. McPhee, Huntington Beach; C. Kenneth Lovejoy, Tustin; Giuseppe Sacca, Niguel, all of Calif.

[73] Assignee: McGaw, Inc., Irvine, Calif.

[21] Appl. No.: 292,232

[22] Filed: Aug. 17, 1994

[51] Int. Cl.[6] ..... A61J 1/00

[52] U.S. Cl. ..... 141/329; 141/114; 141/320; 141/383; 141/386; 53/489; 604/408; 604/412

[58] Field of Search ..... 141/21–28, 319, 141/320, 329, 330, 114, 383, 386; 604/408, 41–416; 53/489

[56] References Cited

U.S. PATENT DOCUMENTS

| | | | |
|---|---|---|---|
| 2,954,769 | 10/1960 | Callahan et al. | 604/413 |
| 2,957,609 | 10/1960 | Holmes | 141/329 X |
| 3,563,415 | 2/1971 | Ogle | 222/145 |
| 3,788,369 | 1/1974 | Killinger | 141/114 |
| 3,885,607 | 5/1975 | Peltier | 141/329 |
| 3,987,791 | 10/1976 | Chittenden et al. | 141/329 |
| 3,994,293 | 11/1976 | Ferro | 128/214 |
| 3,999,543 | 12/1976 | Lacey | 128/272 |
| 4,022,205 | 5/1977 | Tenczar | 128/214 |
| 4,128,098 | 12/1978 | Bloom et al. | 128/272 |
| 4,129,130 | 12/1978 | Bigarella | 128/218 |
| 4,180,070 | 12/1979 | Genese | 128/218 |
| 4,244,378 | 1/1981 | Brignola | 128/766 |
| 4,244,467 | 1/1981 | Cavazza | 206/222 |
| 4,432,755 | 2/1984 | Pearson | 604/56 |
| 4,467,588 | 8/1984 | Carveth | 53/425 |
| 4,550,825 | 11/1985 | Sutryn et al. | 206/222 |
| 4,589,879 | 5/1986 | Pearson | 604/411 |
| 4,607,671 | 8/1986 | Aalto et al. | 141/329 |
| 4,675,020 | 6/1987 | McPhee | 604/411 |
| 4,759,756 | 7/1988 | Forman et al. | 604/413 |
| 4,781,679 | 11/1988 | Larkin | 604/88 |
| 4,936,841 | 6/1990 | Aoki et al. | 604/413 |
| 5,169,388 | 12/1992 | McPhee | 604/416 X |
| 5,423,793 | 6/1995 | Isono et al. | 604/408 X |

FOREIGN PATENT DOCUMENTS

| | | | |
|---|---|---|---|
| 2105695 | 3/1983 | United Kingdom . | |
| 8601712 | 3/1986 | WIPO | 604/412 |

OTHER PUBLICATIONS

A sketch of a drug applicator sold by Burroughs Wellcome Company of Research Triangle Park, NC, under the FLO–PACK® mark (enclosed as Attachment A).

*Primary Examiner*—J. Casimer Jacyna
*Attorney, Agent, or Firm*—Christie, Parker & Hale

[57] ABSTRACT

A binary connector intercouples a plugged drug vial and a plugged, flexible-walled diluent container so that the diluent can pass to the vial from the container only after the latter has been pressurized by squeezing. Sharp-tipped, hollow spikes with intercommunicating axial bores extend in diametrically opposite directions from a disk-shaped base, with jaws having circularly arrayed flexible arms extending in diametrically opposite directions from the base, coaxially around respective ones of the spikes. A compressible rubber plug is wedged in one of the bores. A vial is engaged to a container for liquid communication by snapping the connectors' jaws around their respective inlets, causing the connectors' hollow spikes to pierce their respective plugs. However, not until the container is squeezed is the plug expelled from the blocked bore and communication established between vial and container.

18 Claims, 10 Drawing Sheets

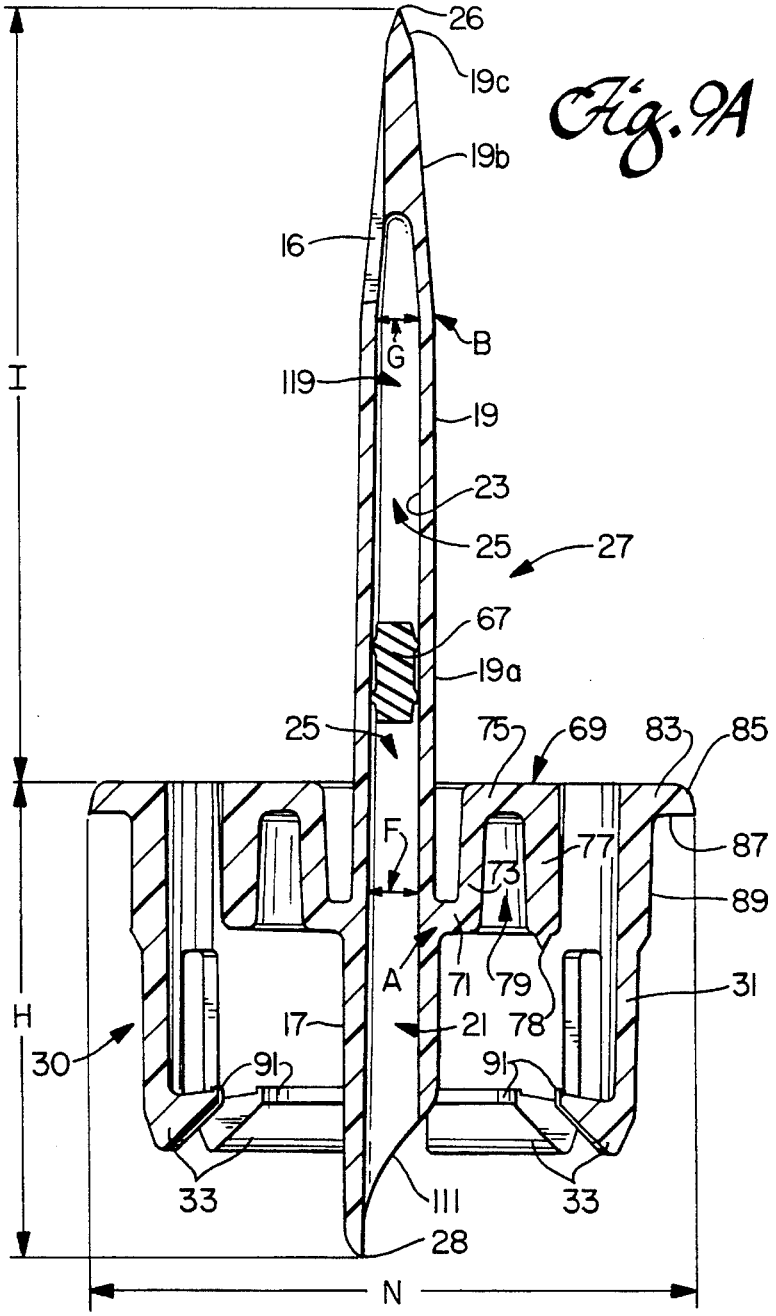
Fig. 9A
Fig. 9B
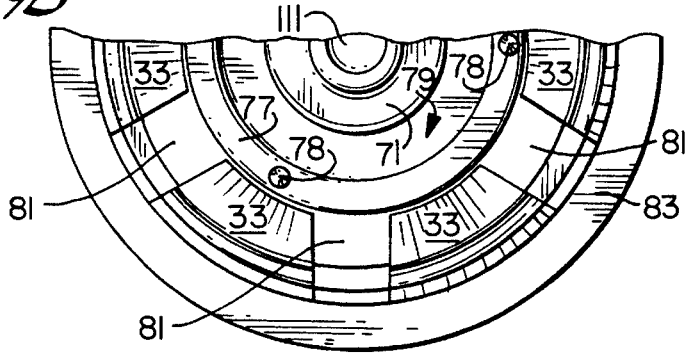

PRESSURE-ACTIVATED MEDICATION TRANSFER SYSTEM

FIELD OF THE INVENTION

This invention relates to a connector for securely intercoupling a diluent container and a drug vial while establishing communication between them so that the diluent may flow between the container and the vial.

BACKGROUND OF THE INVENTION

Medication that is to be administered to a patient intravenously as a solution is conventionally packaged separately from the solution. That is, the medication is packaged in a drug vial, while a diluent, such as a 5% dextrose solution, in which the medication is to be eventually dissolved, is stored in a flexible container. Vial and container are individually sealed.

The diluent container has an inlet port sealed with a pierceable diaphragm, and the drug vial is sealed with a pierceable stopper. When a pharmacist receives a request for a particular medication that is to be intravenously administered, he selects the vial containing the required drug and a diluent container and interconnects the two by means of a connector which is provided with diametrically oppositely-extending hollow spikes for penetrating the stoppers in the vial and the container. Although the pierceable stoppers of the drug vial and of the container are penetrated by the above assembly, it is desirable to keep their contents separate until just before the medication is to be administered to the patient, since, once the medication is dissolved in the diluent, the solution's lifetime is very limited. Once the assembly reaches the patient's bedside and has been checked to be appropriate, the diluent is partially expelled from its container into the drug vial, mixed with the drug, drawn back from the vial into the container, shaken so as to uniformly distribute the drug in the diluent, and administered from the container to the patient through an outlet port in the container called the "administration port."

In order to ensure that the drug remains separated from the diluent until it is desired to mix the two, means must be provided to prevent the diluent from entering the drug vial through the interconnected hollow spikes. U.S. Pat. No. 4,675,020, issued to Charles J. McPhee and assigned to the present assignee, discloses one such means: a diluent spike scored near its sealed tip so that the tip may be broken off just before the diluent is forced into the drug vial through the now-open end of the diluent spike. While the foregoing expedient is effective, it requires some dexterity to use, and the presence of the broken-off diluent spike tip in the diluent container may be undesirable.

SUMMARY OF THE INVENTION

In accordance with the invention, there is provided a connector for effecting pressurized communication between a pressurizable diluent container and a drug vial through their respective inlets, sealed by respective penetrable stoppers, which reliably keeps the contents of the vial and the container separate until it is desired to mix them, at which time their contents may be intermingled simply by pressurizing the container. Advantageously, the container has flexible walls, and the required pressurization may be accomplished simply by squeezing.

The connector of the present invention includes a base from which there extends in a first direction a drug spike having an axially-extending drug bore open at its distal end. Extending from the base in the opposite direction, coaxially with the drug spike, is a diluent spike having an axially-extending diluent bore open near its distal end and communicating at its proximal end with the proximal end of the drug bore through the base, with the two bores comprising a composite bore, open at or near its opposite distal ends. The connector is provided with a base for sealingly fastening it against the respective inlets of the drug vial and the diluent container when the drug spike and the diluent spike are thrust through their respective penetrable stoppers. In accordance with the invention, a plug is seated in and seals one of the bores, the plug being expellable from the sealed bore when the diluent container is pressurized.

Advantageously, the bore, which is sealed by the plug, is tapered toward the distal end of the diluent spike, and the plug is compressible and is wedged in place in that bore. Since the sealed bore widens toward the distal, open end of the drug spike, the wedged plug may be dislodged by pressurizing the container and using that pressure, exerted against the plug through the diluent spike's opening near its end, to blow the plug into the drug vial which, as noted, can be accomplished simply by squeezing on the diluent container.

In keeping with another aspect of the invention, there is provided a method for sealing a spike having an axial bore, open at one end and vented near its opposite end, the spike having a sharp tip at its open end for insertion into a drug vial. The spike is provided with an axial bore, tapered toward its vented end, and a compressible plug is inserted into the bore through its open end so as to form a space in the bore, which is open only near its vented end. The plug is firmly wedged in the bore by subjecting the space created in the bore by the plug to a partial vacuum through the vented end of the spike, or by pressure from the drug- vial end, or a combination of both. Preferably, the taper of the bore, relative to the size of the plug, is selected so as to cause the plug to become wedged in the bore so as to permit the plug to be subsequently expelled through the open end of the bore into the drug vial when a pressure of about 10 pounds or less per square inch is applied to the space through the spike's vented end. Thus, when the vented portion of the spike, serving as a diluent spike, is inserted into a flexible-walled diluent container, the pressure necessary to expel the plug can be readily exerted by folding the container upon itself and squeezing it.

Yet another aspect of the invention is the construction of the connector so that it firmly grips and interconnects a drug vial and a diluent container. Both the container and the drug vial include annular flanges around their respective inlets, and the means on the connector whereby the vial and container are securely interconnected include a pair of oppositely-extending resilient jaws, each comprising a set of teeth surrounding a respective one of the diluent and drug spikes for engaging a respective one of the container and vial inlet flanges. Advantageously, the drug jaw is integral with the base of the connector, whereas the diluent jaw is separate from, but permanently attachable to, the base. Toward this end, the base includes a peripheral flange, and the diluent jaw includes a cap with a peripheral rim having radially-inwardly-sloping ramps, the rim being sized to receive the flange when the latter is pressed into place past the resilient ramps.

In order to permit engagement with containers having their flanges in axially-different positions around their inlet ports, the diluent jaw comprises two alternating sets of arms. The first set of arms is evenly distributed around the diluent jaw cap perimeter, each arm terminating in a short tooth extending radially inward and axially toward the cap. Each of a second set of arms, alternating with arms of the first set, terminates in a long tooth extending radially inward and axially toward the cap farther than the short teeth on either side of it. Thus, two sets of alternating teeth are provided, each set comprising a plurality of teeth evenly distributed around the cap's periphery, with the teeth of one set being axially staggered with respect to the teeth of the other set. By virtue of the two alternating sets of axially-staggered teeth, the connector may be used to engage diluent containers whose respective inlet flanges are axially displaced relative to each other. Furthermore, the two sets of teeth may also be used to advantage where a diluent container has a pair of spaced-apart peripheral flanges around its inlet ports, in which event the two sets of arms may lock onto both flanges with their long and short teeth, respectively.

Some diluent container inlets may have only one flange or no flange at all. They are sealed by means of a rubber plug surrounded by an integral cylindrical cap. The plug fits into and seals the throat of the inlet while the cap is pulled down on the outside of the inlet, providing a second seal. The long teeth of the present invention serve to grip the rubber cap by digging into it, thereby retaining the diluent jaw upon the diluent container's inlet. The plug-cap combination may be used on a diluent container inlet whether or not the inlet has a flange next to the end of the cap. Advantageously, the dual-tooth diluent jaw of the present invention is usable with both types of inlets. Where the flange is present, one set of teeth may engage the flange while the other set digs into the rubber cap above it.

BRIEF DESCRIPTION OF THE DRAWINGS

These features and advantages of the invention, as well as other features and advantages of the invention, will be more apparent from a reading of the claims and of the detailed description of the invention in conjunction with the drawings described below.

FIG. 9A is a partially broken away side view of the connector's spike member, which includes the base and spikes extending therefrom, showing the compressible plug in the diluent spike's bore;

FIG. 9B is a partial bottom view of the spike member of FIG. 9A;

DETAILED DESCRIPTION

Figure 10B:
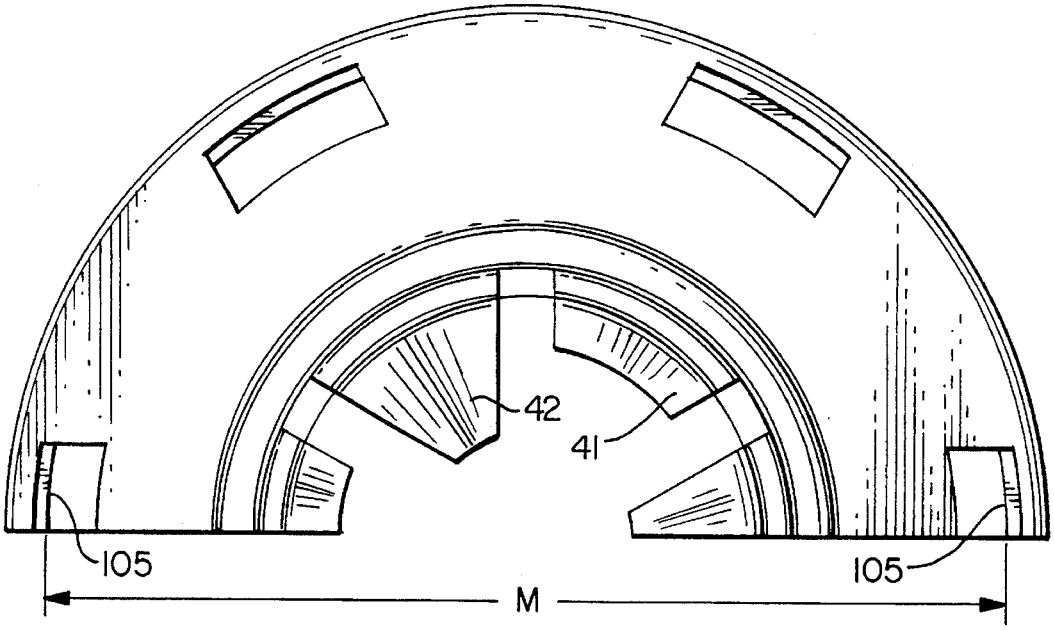
FIG. 10B is a partial top view of the cap member illustrated in cross-section in FIG. 10A.
Figure 10A:
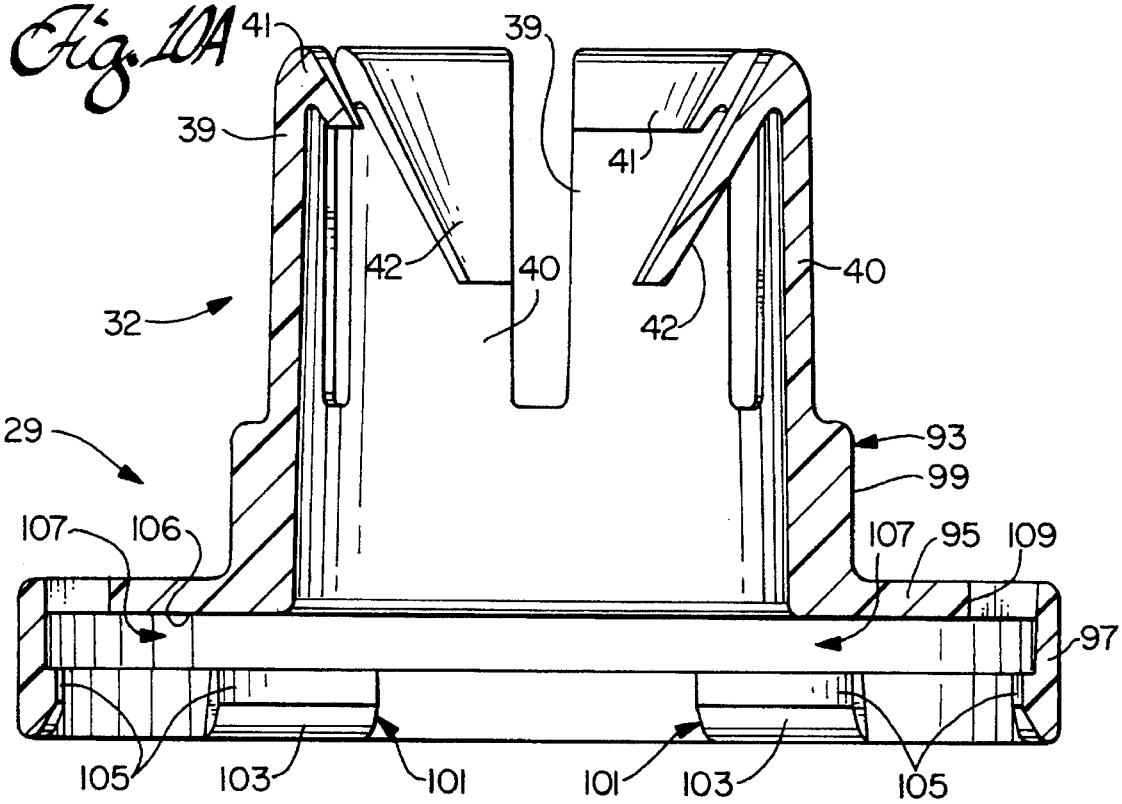
FIG. 10A is a partially broken away side view of the connector's cap member, which includes the diluent jaw with its two sets of alternating long and short teeth.
Figure 11:
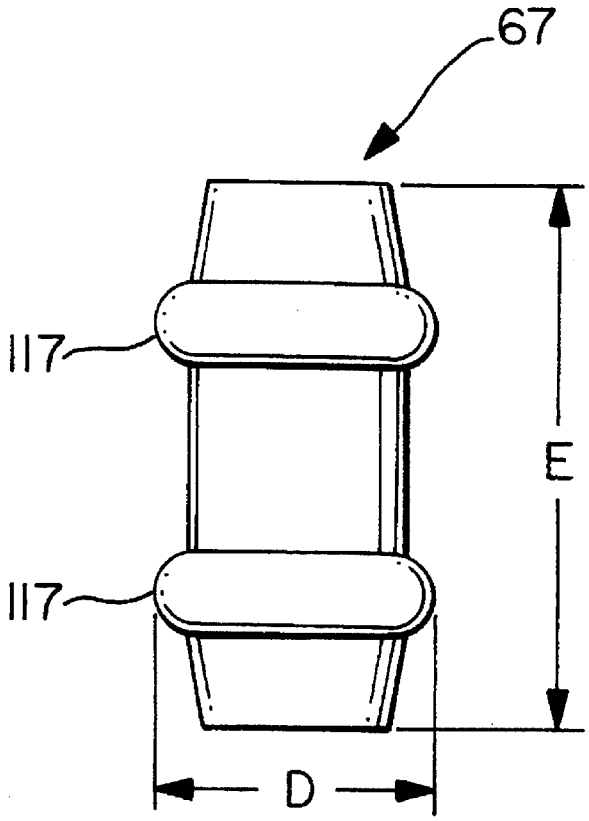
FIG. 11 is a side view of the plug, which is shown being expelled from the diluent bore in FIG. 8.
Figure 12:
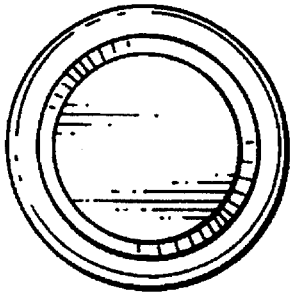
FIG. 12 is a plan view of the plug of FIG. 11.

An exemplary connector 11 incorporating features of the invention is illustrated in its different aspects in FIGS. 1–12. FIGS. 1–8 illustrate the general construction and functional aspects of the connector 11; FIGS. 9, 10, and 11 illustrate its structural aspects in greater detail.

Figure 1:
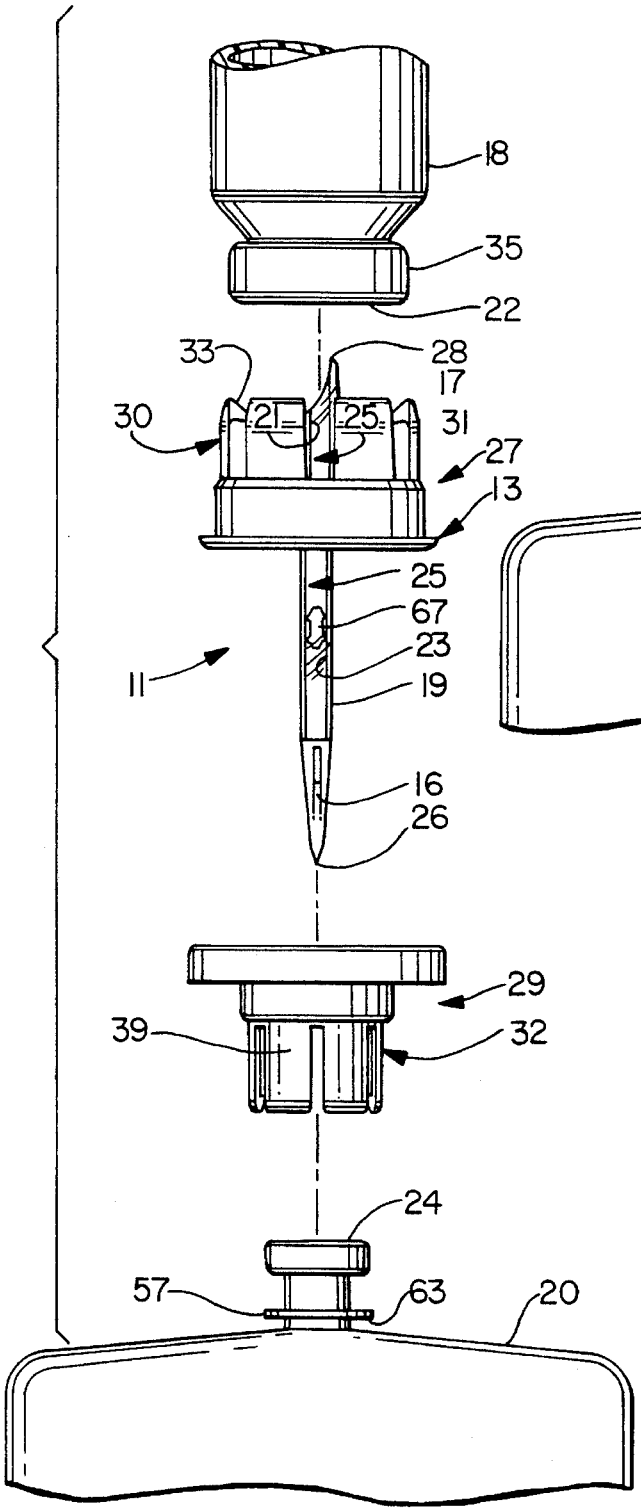
FIG. 1 is an exploded side view of a drug vial, a diluent container, and an exemplary embodiment of a connector provided in accordance with this invention, showing the two constituent parts of the connector, separated.
Figure 2:
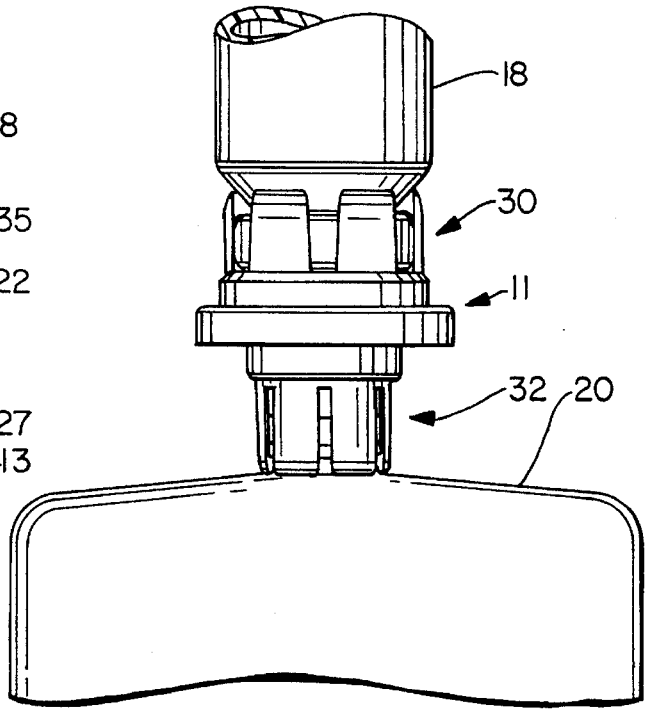
FIG. 2 is a side view of the components illustrated in FIG. 1, with the connector assembled and attached to the vial and the container.

The general construction of a connector 11 may be gleaned from FIGS. 1 and 2, which show the connector 11 as comprising a base 13 from whose center extend a pair of hollow spikes in axially-opposite directions: a drug spike 17 and a diluent spike 19. As best seen in FIG. 9A, extending through the drug spike 17 is a tapered, axial drug bore 21 and, similarly, extending along the diluent spike 19 is a tapered, axial diluent bore 23, the two bores communicating through the base 13 at their proximal ends to form a composite bore 25. The composite bore 25 is open at or near both of its distal ends 26 and 28. It merges into the open end 28 of the drug bore 21 and is ported at its opposite end 26 through a set of three openings 16 (FIG. 9E) in the tip of the diluent spike 19.

Means are provided for sealingly fastening the connector base 13 against the respective inlets 22 and 24 of a drug vial 18 and a diluent container 20. In keeping with one aspect of the invention, the connector 11 is formed of two separate parts: a spike member 27 and a cap member 29, and the fastening means are in the form of jaws 30 and 32 extending from respective ones of those parts. On the spike member 27, the fastening means comprise a drug jaw 30 having a first set of resilient arms 31, tipped by teeth 33 which snap around an annular, apertured retaining cap 35, holding in place a pierceable rubber stopper 37 in the drug vial's inlet 22. On the cap member 29, the fastening means comprise a diluent jaw 32 having a second set of resilient arms 39, tipped by teeth 41 (FIG. 7A) to snap onto a flange 57 around the diluent container's inlet 24. For clarity, the spike member 27 and the cap member 29 of the connector 11 are shown separated in FIG. 1 and snapped together in FIG. 2, with their respective jaws 30 and 32 in place on the drug vial 18 and the diluent container 20.

Figure 6:
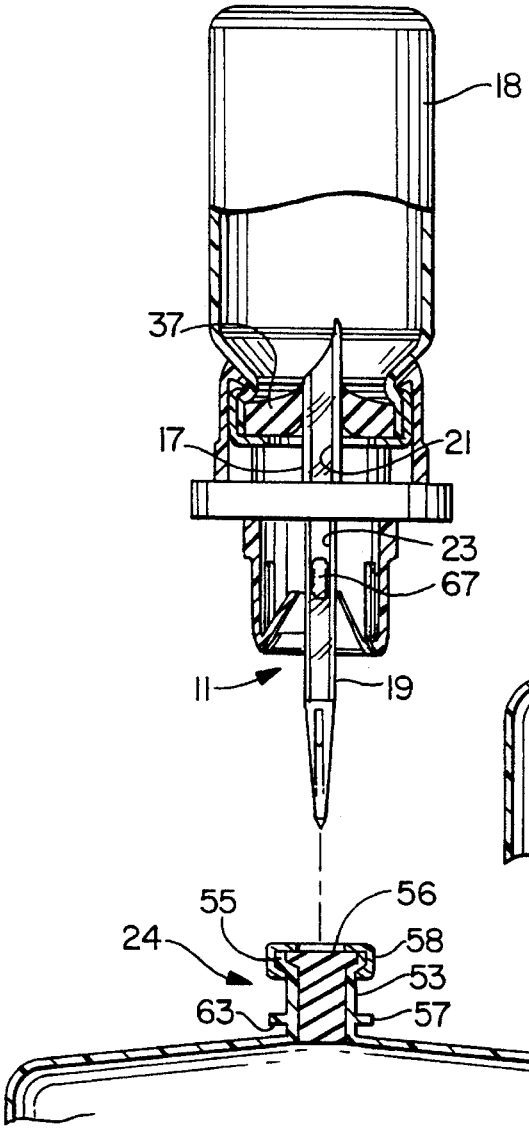
FIG. 6 is a partially broken away side view of the drug vial, inverted, with the connector attached thereto and with the diluent spike of the connector (exposed by removal of the connector's second protective cap), shown next to the inlet port of the diluent container prior to insertion therein, and revealing a compressible plug in the bore of the diluent spike.
Figure 7:
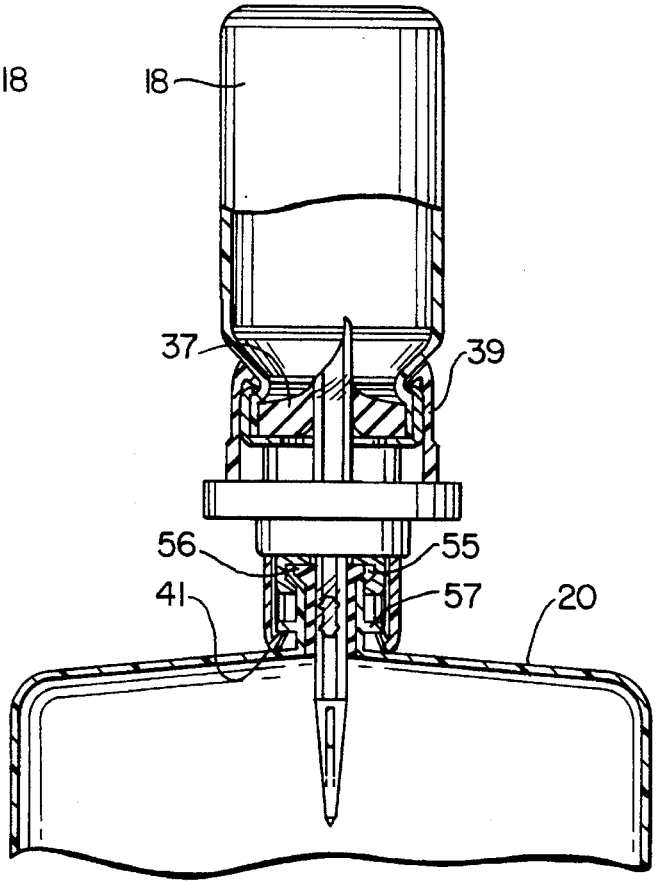
FIG. 7 is a partially broken away side view of the connector fully attached to both the drug vial and the diluent container, with the connector's diluent spike penetrating into the diluent container.

Specifically (FIG. 4), the drug vial's inlet 22 is formed by a neck 49 terminating in a collar 51 that is surrounded by the annular, apertured retaining cap 35 for holding in place the stopper 37. The diluent container's inlet 24 (FIG. 6) is formed by a neck 53 having first and second axially-spaced-apart annular flanges 55 and 57. The first annular flange 55, nearest the mouth of the inlet 24, is encircled by an annular, apertured retaining cap 58, which holds a pierceable rubber stopper 56 in place. The second annular flange 57 is the primary means for anchoring in place the cap member 29 whose teeth 41 snap into place on the underside of the second annular flange 57 (FIG. 7). As noted in the "Summary of the Invention," the teeth 41 constitute one of two sets of axially-spaced-apart teeth on the cap member 29. The other set of teeth will be described later with reference to FIGS. 10A and 10B.

Figure 3:
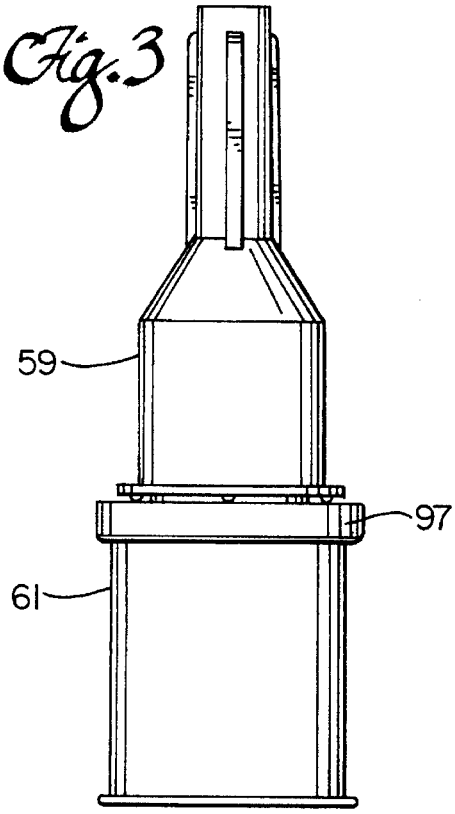
FIG. 3 is a side view of the connector of FIGS. 1 and 2 covered by a pair of protective caps.
Figure 4:
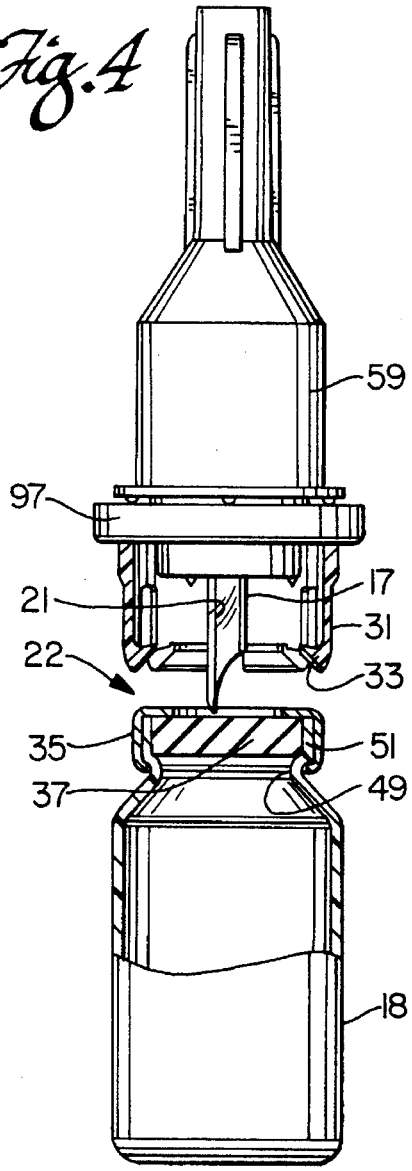
FIG. 4 is a partially broken away side view of the connector with one of its protective caps removed and ready to be attached to the drug vial.
Figure 5:
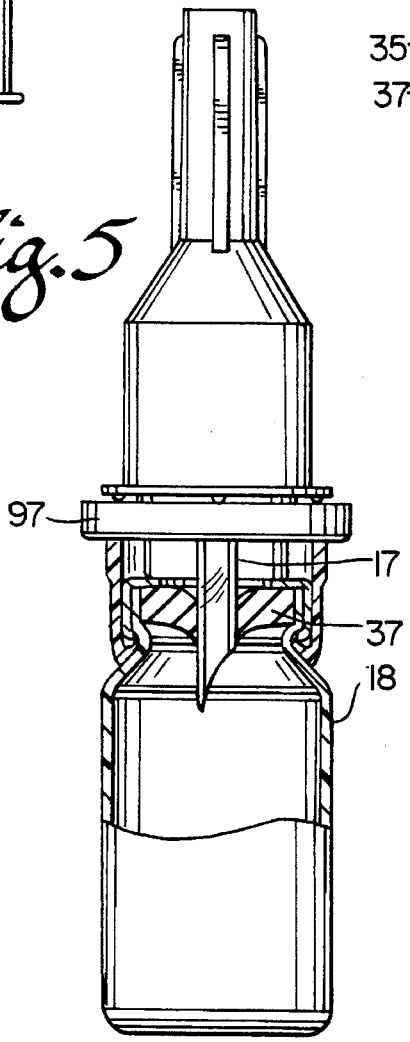
FIG. 5 is a partially broken away side view of the connector attached to the drug vial, with the drug spike of the connector penetrating the vial's stopper.

Referring particularly to FIG. 3, the connector of the present invention is packaged with a top guard cover 59 to protect the diluent spike 19 and a bottom guard cover 61 to protect the drug spike 17. Referring to FIG. 4, the first step in using the connector 11 is to remove its bottom guard cover 61 so as to expose its drug spike 17 and to place it next to the pierceable rubber stopper 37 of the drug vial 18. With the drug vial 18 firmly in one hand and the connector 11 held in the other hand by its top guard cover 59, the user presses the connector 11 against the drug vial so that the flexible arms 31 of its jaw 30 slide past the annular, apertured retaining cap 35 of the drug vial 18 and snap in place just below it. As this occurs, the drug spike's sharp tip 17 penetrates the pierceable rubber stopper 37 (FIG. 5).

Next, the user removes the top guard cover 59 from the connector 11 and places the tip of the diluent spike 19 opposite the diluent container's inlet 24. As best seen in FIGS. 6, 7, 8A, and 7B, with the drug vial 18 as a handle, the connector 11 is then thrust against the container 20 so that its teeth 41 slide past both the first annular flange 55 and the second annular flange 57 and snap in place against the bottom shoulder 63 of the latter. During the same sequence, the teeth 42 slide past the first annular flange 56 and snap in place against the underside of the apertured cap 58. This is the fully-engaged position of the connector 11, which is also illustrated in FIG. 2, wherein the drug vial 18 and the diluent container 20 are interlocked and their pierceable rubber stoppers 37 and 56 are penetrated by the drug spike 17 and the diluent spike 19, respectively.

Figure 8:
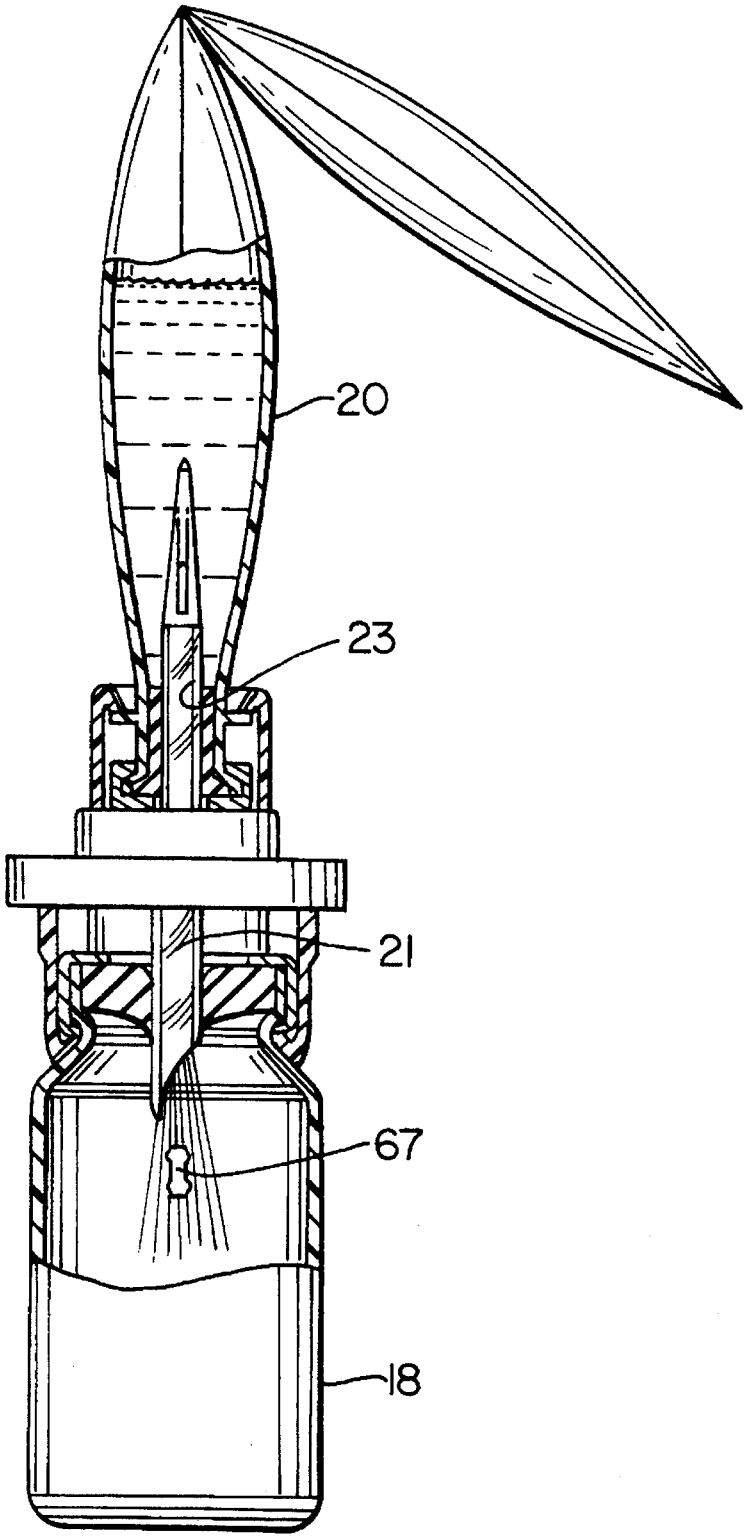
FIG. 8 is a partially broken away side view of the assembly of FIG. 7, but with the diluent container pressurized by being folded upon itself and squeezed, thereby expelling the compressible plug from the diluent spike bore into the drug vial.

In accordance with the invention, means are provided to keep the contents of the drug vial 18 and the diluent container 20 separate until it is desired to intermix them. The separating means comprises a plug 67, which is seated in and seals one of the bores (in the illustrated embodiment, the diluent bore 23), the plug being expellable from the sealed bore when the diluent container 20 is pressurized. The manner in which this is most readily accomplished is shown in FIG. 8: the container is folded upon itself and squeezed until sufficient pressure is developed therein to dislodge the plug 67 from the diluent bore 23 and to blow it clear through the drug bore 21 and into the drug vial 18.

Turning next to the configuration of the connector 11, its two constituent parts, the spike member 27 and the cap member 29, both of which are preferably formed of radiation-grade polycarbonate, are illustrated respectively in FIGS. 9-A through 9-E and 10A and 10B. The spike member 27 comprises a generally disk-shaped base 69 with a convoluted cross-section, from whose center there extend, in diametrically-opposite directions, the diluent spike 19 and the drug spike 17. Addressing first the structural details of the base 69, and following its cross-section from its center toward its perimeter, the innermost portion of the base 69 (where it joins the proximal ends of the diluent spike 19 and the drug spike 17) is a first radially-extending annular web 71, which transitions into an inner annular wall 73 that extends from the web around the diluent spike toward its distal end 26. The inner annular wall 73 transitions at the upper surface of the base 69 into a second radially-extending annular web 75 from which, in turn, extends an outer annular wall 77 that extends generally parallel to the inner annular wall 73, so that the inner and outer axially-extending annular walls 73 and 77, together with the second radially-extending web 75, form an annular channel 79. Extending axially from the rim of the outer annular wall 77 are three symmetrically-placed, pointed projections 78 (two of which are shown in FIG. 9B). After the connector 11 has been pressed into place on the diluent container 20 (as seen in FIG. 6), the projections 78 serve to form indentations in the retaining cap 58 of the diluent container's inlet 24, to accommodate container-to-container variation in the distance between the top of the remaining cap 58 and the bottom shoulder 63 of the second annular flange 57, as explained in greater detail in U.S. Pat. No. 4,675,020, which is incorporated herein by this reference.

Turning particularly to FIGS. 9A and 9B, extending from, and generally coplanar with, the second radially-extending annular web 75, are a set of radially-extending ribs 81, terminating in a peripheral flange 83 having an arcuate outer rim 85, underlying which is a flat shoulder 87 facing in the same direction as the drug spike's distal end 28. The convoluted geometry of the base 69 serves to provide a flexible and resilient anchor point for the spikes 17 and 19.

The drug jaw 30, the means by which the connector 11 is locked onto the drug vial 18, comprises the first set of resilient arms 31 which are rooted in a common, circular hoop 89 that extends from the underside of the peripheral flange 83 toward the drug spike's distal end 28. The arms 31 may be identically configured, as shown in FIG. 9A, each terminating in a radially-inwardly-extending tooth 33, each of which has an axially-extending tip 91.

Constituting the second composite part of the connector 11 is the cap member 29, illustrated in FIGS. 10A and 10B. It includes a cap 93, having a radially-extending web 95 terminating in an axially-extending, peripheral, annular rim 97. Extending axially in a first direction from the web 95 and forming part of the diluent jaw 32, is a circular hoop 99, from which there extend, parallel to the diluent spike 19 along a perimeter that is coaxial therewith, two alternating sets of resilient arms 39 and 40. When the unit is assembled, arms 39 of the first set terminate in relatively short teeth 41, while arms of the other set 40 terminate in teeth 42, which are substantially longer than those of the first set. Both sets of teeth extend axially inward and radially toward the center of the cap 93.

Figure 7A:
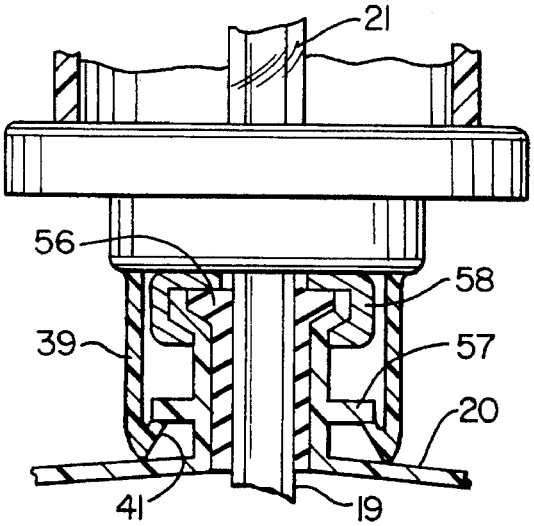
FIGS. 7A and 7B are enlarged views of that area of FIG. 7 which shows the engagement of short and long teeth, respectively, with the diluent container.
Figure 7B:
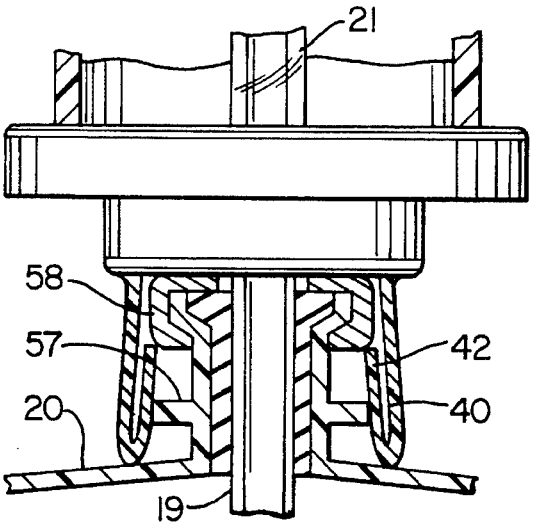

The two alternating sets of resilient arms 39 and 40 serve a dual purpose. Primarily, they permit the connector 11 to accommodate the container 20, whose flanges 55 and 57 are in axially different positions around its inlet 24. Thus, with the flange 57 of the container 20 located as shown in FIG. 1, it is the arms 39 with the relatively short teeth 41 which latch around the flange. Conversely, if the second annular flange 57 were located approximately where the first annular flange 55 is positioned, it would be the arms 40, terminating in the longer set of teeth 42, which would effect locking engagement. A secondary advantage of having two sets of axially-spaced-apart teeth—one set long, the other set short—is that, while the shorter set of teeth 41 engages the second annular flange 57, the longer set of teeth 42 simultaneously engage the annular, apertured retaining cap 58, which surrounds the first annular flange 55 (FIGS. 7A and 7B).

Figure 7C:
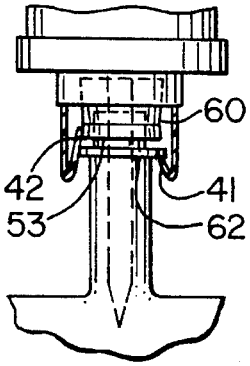
FIG. 7C illustrates engagement of the short and long teeth with an alternative container inlet having a single flange and being sealed by a rubber cap.

As previously noted, the use of two alternating sets of arms has a second advantage: It may be used with a diluent container whose inlet port is sealed by means of a rubber plug and an integral rubber cap surrounding the plug. Such an arrangement is shown in FIG. 7C, wherein a rubber cap 60 covers the diluent-container inlet neck 53, around which extends a single flange 62. While the short teeth 41 lock onto the flange 62, the long teeth 42 dig into the rubber cap 60.

Referring particularly to FIG. 10A, distributed, preferably symmetrically, around the inside surface of the peripheral rim 97 are a set of inwardly-sloping resilient ramp members 101, whose sloping ramp surfaces 103 terminate in axially-extending end faces 105, so that the end faces of the ramp members collectively present a discontinuous cylindrical surface whose diameter M (FIG. 10B) is slightly less than the diameter N of the spike member's peripheral flange 83 at its outermost point (FIG. 9A). Consequently, the spike member 27 and the cap member 29 may be simply assembled by pressing the spike member into the cap member in the orientation shown in FIGS. 1 and 2, until the peripheral flange 83 has ridden all the way up the ramp surfaces 103 of the ramp members 101 and has snapped in place in the space between the ends of the ramp members 105 and the bottom inside surface 106 of the cap 93, this space being shown as the annular groove 107 in FIG. 10A. Thus, the rim 97 is sized so as to receive the flange 83 when the latter is pressed into place past the ramps 101. With the spike member 27 and the cap member 29 snapped together, the connector 11 is assembled and appears as shown in FIG. 2. Thus, whereas the drug jaw 30 is permanently attached to the base 13, the diluent jaw 30 is separate from, but permanently attachable to, the base.

The slots 109 provide clearance for tooling used to fabricate the ramp members 101 and do not factor in the functioning of the cap member 29.

Referring to FIG. 9A, in the preferred embodiment illustrated herein, the diluent spike 19 and the drug spike 17 extend in opposite directions from point A of the base 13 of the spike member 27, where their proximal ends are anchored. The bores of the respective spikes extend axially within those spikes and, in the preferred embodiment, merge smoothly, without transition, so as to form a composite bore 25, tapered along its length toward the tip, or the diluent spike's distal end 26.

Figure 9C:
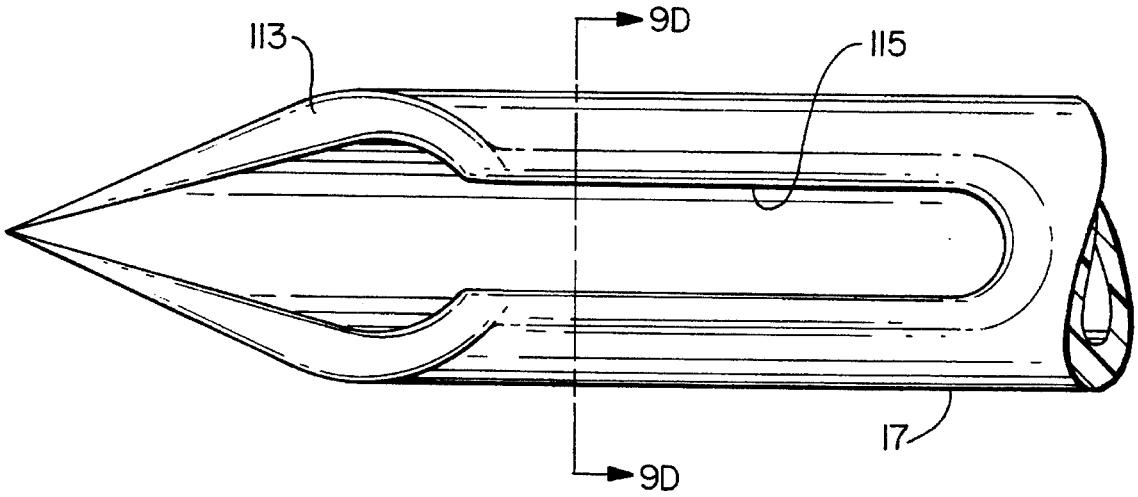
FIG. 9C is a side view of the drug spike portion of the spike member of FIG. 9A.
Figure 9D:
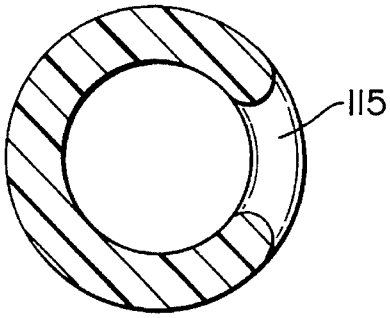
FIG. 9D is a cross-section through the slotted end of the drug spike of FIG. 9C.
Figure 9E:
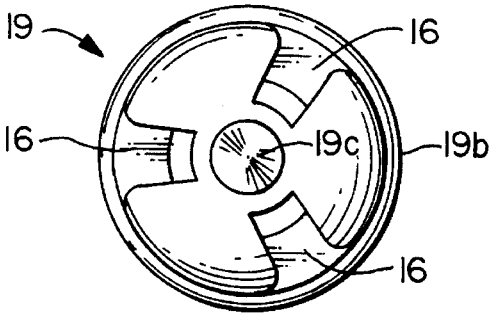
FIG. 9E is a partial top view of the connector part of FIG. 9A, illustrating, in particular, the vented end of its diluent spike.

Referring particularly to FIGS. 9C and 9D, the drug spike 17 terminates in an open end 111, formed at an angle to provide a sharp tip 113. Extending from the drug spike's open end 111 toward its proximal end, is an axial slot 115, to provide an enlarged opening for the drug that is to pass through the spike.

Returning to FIG. 9A, the diluent spike 19 has three principal regions for maximum strength compatible with effectiveness in penetrating a diluent container's pierceable rubber stopper 56. The widest, root section 19*a* of the diluent spike 19 is between its proximal end at point A, at the base of the spike member 27, and a point B, which is about two-thirds of the way between the base 13 and the diluent spike's distal end 26. Along this root section, the diluent spike 19 has a first, very slight, taper. A second section 19*b* of the diluent spike 19 extends between point B and a point C, which is very near the spike's tip. This intermediate spike section 19 has a more pronounced taper than that of the root section 19*a* and includes a plurality, preferably three, symmetrically-distributed openings 16, seen in FIG. 9E. The number of openings 16 is not critical to the invention, but is very helpful in the manufacturing of the spike member 27, because the openings allow the needle portion of a mold to be held securely centered through the openings 16 during manufacture. The terminal section 19*c* of the diluent spike 19, between point C and the diluent spike's distal end 26, has an even greater taper than the intermediate spike section 19*b* and serves as a needle point for penetrating the pierceable rubber stopper 56.

An important feature of the invention is the means by which the composite bore 25 is blocked so that it may be unblocked by pressurizing the container. The means disclosed herein is a compressible plug 67, best seen in FIGS. 11 and 12, made preferably of an elastomer, such as butyl rubber. In its preferred configuration, the plug 67 is a solid, roughly-barrel-shaped member, tapered at its distal ends, with a pair of axially-spaced-apart annular ridges 117. The reason for using a solid rubber plug, as opposed to one having hollows therein which might make it more compressible, is to ensure that, when the plug 67 is expelled from the diluent bore 23 into the drug vial 18 (FIG. 8), it does not float, thereby possibly reentering and blocking the bore 23 when the diluent-medication solution is withdrawn from the drug vial through the composite bore 25 into the diluent container 20.

The plug 67 is wedged in place near the middle of the composite bore 25 and, more particularly, in the bottom half of the diluent bore 23 as seen in FIG. 9A.

To retain the plug 67 in the composite bore 25 and, specifically, in its diluent bore portion 23, until it is expelled by pressurizing the diluent container 20, the plug is wedged in place. This is accomplished by providing the composite bore 25 with a taper which is carefully dimensioned so that, when the plug 67 is forced through the opening at the drug spike's distal end 28 into the composite bore 25, toward the diluent spike's distal end 26, it will become wedged in the diluent spike 19 and, in particular, in the section 19*a* between its points A and B, so that the plug does not block the openings 16. Accordingly, the composite bore 25 is tapered toward the diluent spike's distal end 26 and is precisely dimensioned between points A and B to ensure that the plug 67 is capable of entering that region (at A), but incapable of passing beyond it (at B). Toward this end, the dimensions of the composite bore 25 and, most particularly, the diluent bore 23 are precisely specified in the aforementioned region so that the diameter F of the bore at the base of the diluent spike 19 near point A is slightly larger than the outside diameter D of the plug ridges 117, and so that the diameter G of the diluent bore 23 near point B is slightly smaller than the plug diameter D.

Rubber parts, such as the plug 67, are available from a number of manufacturers, among them, specifically, the West Company of Phoenixville, Pa. The West Company applies an anti-friction coating, identified by it as Pur/Coat™, to rubber parts which it supplies, and it is preferred that such a coating be applied to the plug 67. In addition, just prior to assembly into the diluent bore 23, it is advisable to coat the rubber plug 67 with a silicone layer for further lubrication and ease of installation into the diluent bore. Lubricating and coating the rubber plug 67, provides a consistency in the position it will assume in the diluent bore 23 and in the force required to dislodge it.

To install the rubber plug 67, it is dropped through the open end of the drug bore 21 into the diluent bore 23, so that the plug forms a space 119, which is open only through the openings 16 near the diluent spike's distal end 26. A partial vacuum may then be applied through those openings to the partially-enclosed space 119, causing the plug 67 to be drawn further into the diluent bore 23 and, because of the taper of the diluent bore, to become wedged and remain therein, until it is dislodged by pressurizing of the container 20 in which it is installed.

It is known that the amount of pressure that can be readily produced by the average user's squeezing on a folded container in the manner shown in FIG. 8, is between 5 and 10 pounds per square inch. Consequently, it is preferred that the relative sizes of the dimensions D of the plug 67 and F and G of the diluent spike 19 be such that the plug can be dislodged when a pressure between 5 and 10 pounds per square inch is exerted through the openings of the diluent spike against the plug. Therefore, a vacuum of 10–20 inches of Hg, (which corresponds to a pressure of 5–10 pounds per square inch) will need to be drawn from the diluent spike 19 during the process of installing the plug 67 therein to properly position the plug in the spike.

While it is preferred to install the plug 67 by pulling a vacuum, it could also be wedged in place by exerting air pressure against it through the spike's open end 111 or mechanically, by pushing it in place with a plunger with a precisely monitored force. A prototype version of the connector 11 of the present invention was constructed with the following key dimensions, in inches:

| | |
|---|---|
| D = .103/.108 | H = 1.150 |
| E = .200 | I = 1.400 |
| F = .109/.113 | M = 1.080 |
| G = .091/.095 | N = 1.095 |

It is apparent from the foregoing that the present invention has advanced the art of binary connectors, one which is an improvement in several respects. The binary connector 11 of the present invention is easy to use, does not leave a sharp fragment in the diluent container 20, is relatively inexpensive to manufacture, and may be adapted for use with diluent containers of different inlet configurations. The connector 11 of the present invention is easy to use, since all that is required to activate it is a squeeze on the diluent container 20. It is easy to manufacture because of its construction, and its rubber plug 67 presents an unobjectionable and hardly noticed residue.

The above descriptions of preferred embodiments of the pressure-activated medication transfer system of the present invention are for illustrative purposes. Because of variations which will be apparent to those skilled in the art, the present invention is not intended to be limited to the particular embodiments described above. For example, in one embodiment of practice of the present invention, the top and bottom guard covers 59 and 61, respectively, can be designed so that they completely surround and cover all portions of the transfer system, including the peripheral rim 97 of the cap member 29. In this instance, the annular rims around the openings of the top and bottom guard covers mate when the covers are installed and can be heat-sealed together to thereby provide a tamper-evident package. In a preferred embodiment, the bottom cover is designed to fit more loosely around the drug vial spike than the top guard cover fits around the diluent spike. Thus, when pulling the covers apart, the bottom cover is removed first so as to expose the drug spike and after the drug spike is placed into the drug vial, the top guard cover is removed.

Figure 14:
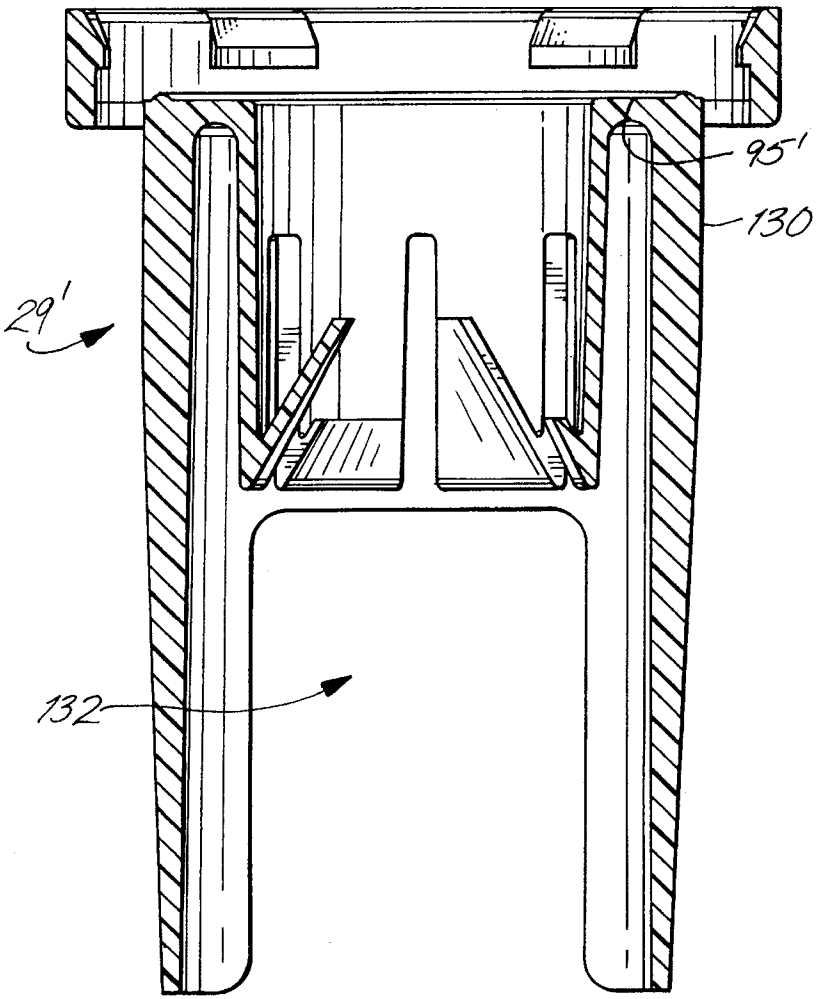
FIG. 14 is a cross-sectional view of the connector cap member taken along line 14—14 of FIG. 13.
Figure 13:
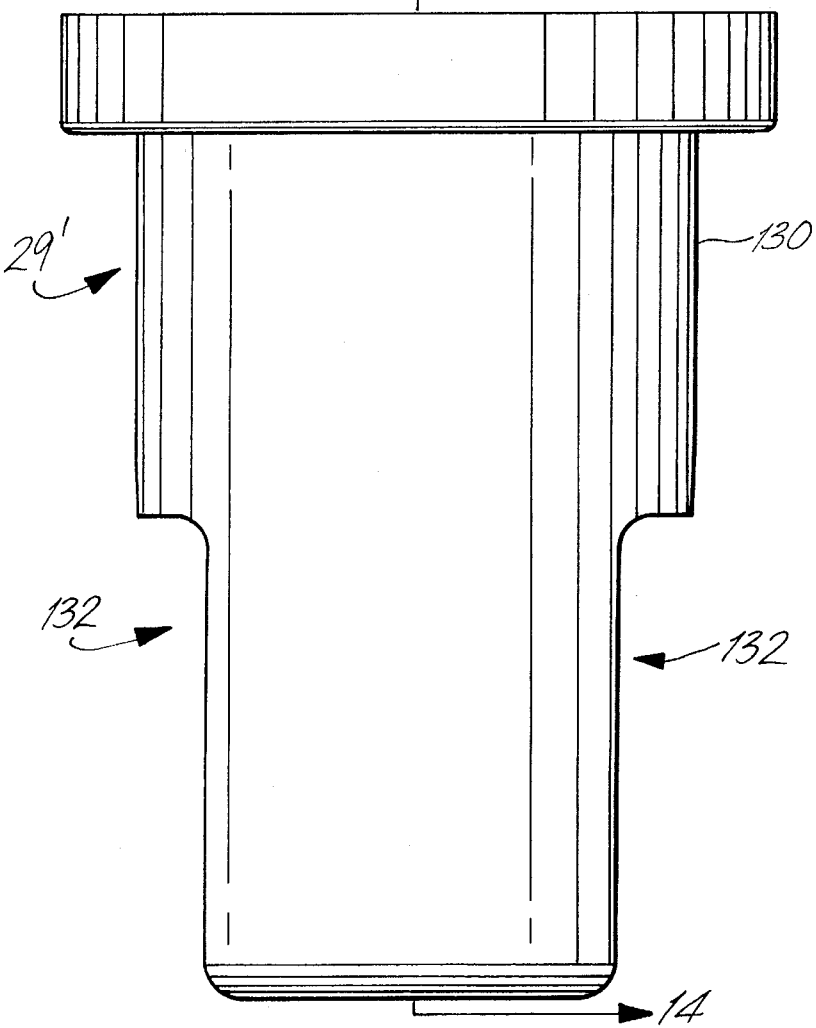
FIG. 13 is a side view of another embodiment of a connector cap member which includes a cylindrical skirt.

Turning to FIGS. 13 and 14, another exemplary embodiment of a cap member 29' is shown. In this embodiment, the cap member 29' is constructed substantially identically to the cap 29, with the exception that it incorporates an elongated skirt 130. The components of the cap 29' which are identical to those described with respect to the cap 29 are identified with the same reference numerals, which are primed (′). In this instance, the cylindrical skirt 130 is integral with the cap 29' and extends axially away from the radially extending web 95'. A pair of slots 132 are in the portion of the cylindrical skirt distal from the web 95'. The spike member 27 (shown, for example, in FIG. 1) is assembled to the cap member 29' the same way as is described above for its assembly with the cap member 29. The slots 132 in the skirt 130 are across from each other and accommodate the top portion of a diluent container, such as the container 20 (shown in FIG. 2), as the diluent spike is inserted into the container.

The scope of the invention is described in the following claims.

What is claimed is:

1. A connector for effecting pressurized communication between a pressurizable diluent container and a drug vial through respective openings sealed by respective penetrable stopper means, comprising:

(a) a base;

(b) a drug spike extending from said base in a first direction and having an axially extending drug bore open at its distal end;

(c) a diluent spike extending from said base in a second direction opposite said first direction and coaxially with said drug spike, said diluent spike having an axially extending diluent bore open near its distal end and communicating at its proximal end with the proximal end of said drug bore through said base;

(d) means for sealingly fastening said base against the respective openings of said drug vial and said diluent container when said drug spike and said diluent spike are thrust through the respective penetrable stopper means of said vial and said container; and (e) a plug seated in and sealing one of said bores, said plug being disposed completely within said bore and being expellable from said sealed bore when said diluent container is pressurized.

2. The connector of claim 1, wherein the sealed one of said bores is tapered toward the distal end of said diluent spike, and said plug is compressible and is wedged in place in said tapered bore.

3. The connector of claim 2, wherein said tapered bore is the drug bore.

4. The connector of claim 2, wherein the tapered bore is dimensioned relative to said plug to cause said plug to be wedged in place within the sealed one of said bores.

5. The connector of claim 4, wherein said plug is cylindrical, has at least one annular sealing ring integral therewith, and has a cross-sectional size at its sealing ring that is less than the cross-sectional size of a first end of said tapered bore at one of its ends and greater than the cross-sectional size of the bore at its opposite end.

6. The connector of claim 1, wherein said drug bore and said diluent bore merge into each other to form a single composite bore having a continuous taper extending through both said drug spike and said diluent spike.

7. The connector of claim 6, wherein said tapered bore is dimensioned relative to said plug to cause said plug to become wedged in place in the diluent bore portion of said composite bore when forced therein.

8. The connector of claim 7, wherein said tapered bore is dimensioned relative to said plug to cause said plug to be wedged in place within said diluent bore.

9. The connector of claim 8, wherein said plug is cylindrical, has at least one annular sealing ring integral therewith, and has a cross-sectional size at its sealing ring that is less than the cross-sectional size of a first end of said tapered bore at one of its ends and greater than the cross-sectional size of the bore at its opposite end.

10. The connector of claim 9, wherein said plug is so configured and constituted that, when immersed in water, it sinks.

11. The connector of claim 10, wherein said plug is solid butyl rubber, coated with an anti-stick compound.

12. The connector of claim 1, wherein said container and said vial each includes an annular flange around its respective opening, and wherein said means for sealingly fastening said bore includes a resilient diluent jaw and a resilient drug jaw, each jaw comprising a set of teeth surrounding a respective one of said diluent and drug spikes for engaging a respective one of said container and vial flanges.

13. The connector of claim 12, wherein said drug jaw is integral with said base, and said diluent jaw is separate from but permanently attachable to said base.

14. The connector of claim 13, wherein said base includes a peripheral flange, and said diluent jaw includes a cap with a radially extending web terminating in a peripheral rim having radially inwardly sloping resilient ramps, said rim being sized to receive said peripheral flange when pressed into place past said resilient ramps.

15. The connector of claim 14, wherein the diluent jaw additionally incorporates a cylindrical skirt which extends axially away from the radially extending web, the skirt comprising a pair of opposed slots for accommodating the top portion of the diluent container when the diluent spike is in the container.

16. The connector of claim 14, wherein said diluent jaw comprises a set of resilient arms extending from said cap substantially parallel to said diluent spike along a perimeter which is coaxial therewith.

17. The connector of claim 16, wherein said diluent jaw comprises a first set of arms evenly distributed about said cap perimeter, each arm terminating in a short tooth extending radially inward and axially toward said cap, and a second set of arms alternating with said first set of arms around said cap perimeter, each of said second set of arms having a long tooth extending radially inward and axially toward said cap farther than said short teeth.

18. The connector of claim 1, wherein said container has flexible walls, whereby said container may be pressurized by squeezing.

* * * * *